United States Patent [19]

Muller et al.

[11] 4,432,112

[45] Feb. 21, 1984

[54] MACHINE FOR CLEANING SHOE SOLES

[76] Inventors: Max Muller, 10920 W. 100th Ter., Overland Park, Kans. 66214; Eugene B. Lilly, 4209 W. 104th Ter., Overland Park, Kans. 66207; Richard E. Bott, R.R. 2, Box 214, Peculiar, Mo. 64078

[21] Appl. No.: 209,672

[22] Filed: Nov. 24, 1980

[51] Int. Cl.[3] ..... A47L 23/22

[52] U.S. Cl. ..... 15/36; 15/311

[58] Field of Search ..... 15/36, 310, 311, 37

[56] References Cited

U.S. PATENT DOCUMENTS

| | | | |
|---|---|---|---|
| 834,975 | 11/1906 | Hammond | 15/36 |
| 3,060,475 | 5/1962 | Dufault | 15/36 |
| 3,084,361 | 4/1963 | Outlaw | 15/36 |
| 3,144,675 | 8/1964 | Canaan | 15/311 |
| 3,787,918 | 1/1974 | Ebert | 15/34 X R |
| 4,024,599 | 5/1977 | Gamboa | 15/311 |
| 4,190,919 | 3/1980 | Burford | 15/36 X |

FOREIGN PATENT DOCUMENTS

| | | | |
|---|---|---|---|
| 2156816 | 5/1973 | Fed. Rep. of Germany | 15/311 |
| 2811094 | 9/1979 | Fed. Rep. of Germany | 15/36 |

*Primary Examiner*—Chris K. Moore

*Attorney, Agent, or Firm*—Kokjer, Kircher, Bradley, Wharton, Bowman & Johnson

[57] ABSTRACT

A machine for cleaning the soles of shoes such as bowling shoes. A rotary brush for cleaning leather shoe soles and an elastomeric roller for cleaning rubber shoe soles are mounted on a hinged platform along with a drive motor and a fan which is used to dry the shoes. The machine is equipped with a solid state circuit which provides an attract sound periodically and a sound which simulates the sound of an electric motor during operation. A power boost arrangement permits operation of the machine at a high speed and provides a sound simulating high speed operation of the motor.

13 Claims, 7 Drawing Figures

Fig. 1.
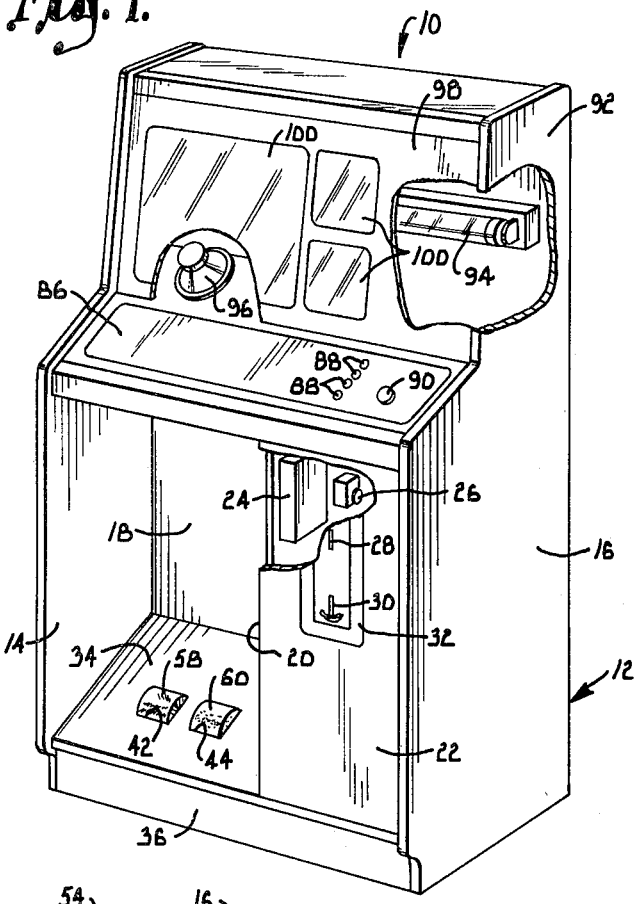
Fig. 2.
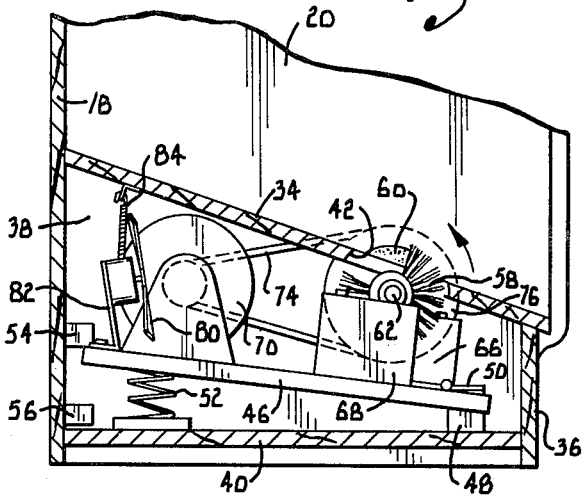
Fig. 3.
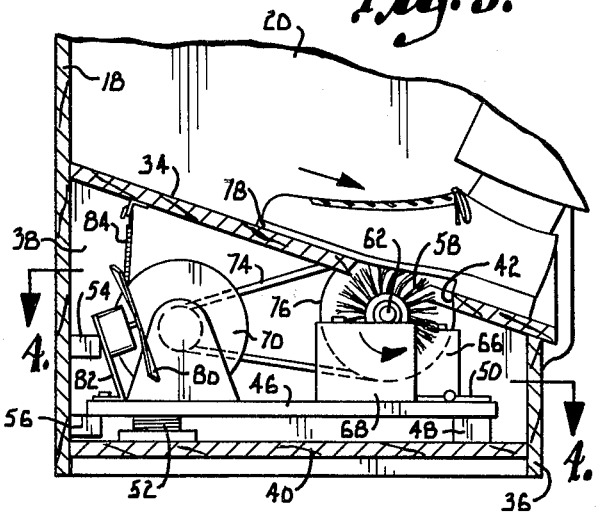
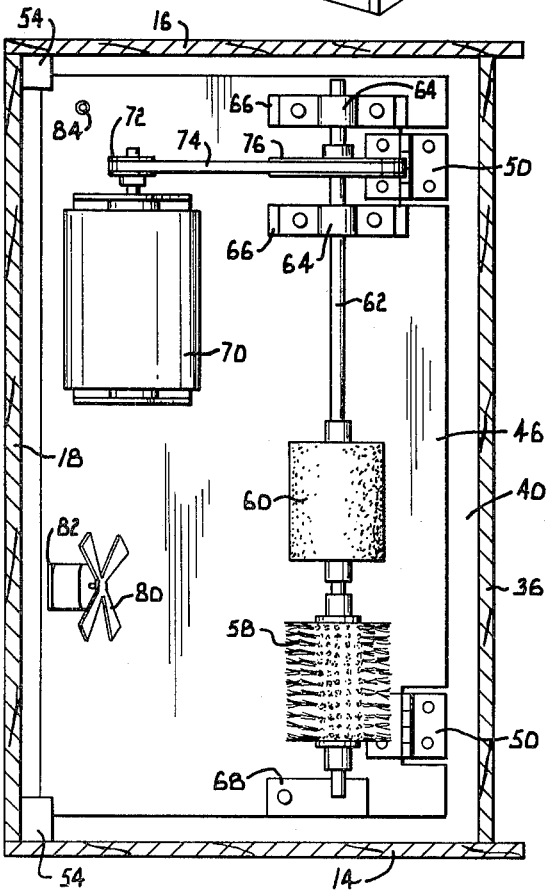
Fig. 4.

MACHINE FOR CLEANING SHOE SOLES

BACKGROUND OF THE INVENTION

This invention relates to an improved machine for cleaning shoe soles and particularly the soles of bowling shoes and other athletic shoes. The invention is an improvement over the device shown in U.S. Pat. No. 4,190,919 to Burford.

In bowling and many other sports, the condition and cleanliness of the shoes can have a significant impact on the performance of the participants. For example, if excessive quantities of dirt or other foreign materials are allowed to build up on the soles of bowling shoes, the bowler cannot slide toward the foul line in the smooth manner necessary for proper delivery of the ball. Instead, the shoes may drag or stick on the floor and thus adversely affect the release of the bowler. Liquids on the shoes can have a similar effect. The shoes are equally important to good performance in other sports.

In recognition of the importance of athletic shoes and the need to maintain the soles in a clean state, various machines have been proposed for cleaning the soles of bowling shoes and the like. However, none of these machines has been commercially successful. The device shown in the aforementioned Burford patent includes a rubber wheel for cleaning rubber soles and a brush for cleaning leather soles. The cleaning implements and drive motor are carried on a spring mounted platform. Although this arrangement is generally satisfactory, it is not totally without problems. There is nothing provided on the machine for drying of the shoes, and the cabinet is not constructed in a particularly attractive or functional manner. Furthermore, there are no special features for attracting potential users as they pass by the machine.

The shoe conditioner shown in U.S. Pat. No. 3,144,675 to Canaan is equipped with a blower arrangement for drying of the shoes. Since a separate conduit system for the blower and a separate outlet slot must be provided, undue expense and complexity are introduced into the machine. Also, the outlet slot for the blower does not coincide with the cleaning brush, and the portion of the shoe sole which is positioned on the brush is not dried at the same time as it is cleaned. Consequently, the drying system is not particularly effective. Equally significant, the blower system is completely isolated from the compartment which houses the motor and the drive system, and the blower cannot remove dirt and other debris that tends to accumulate in the compartment. The heating element that is necessary to heat the air that is circulated by the blower adds significantly to the cost and to the energy consumption of the device.

SUMMARY OF THE INVENTION

It is thus apparent that a need exists for a shoe sole cleaning machine that is more practical than those that have been proposed in the past. It is the primary goal of the present invention to meet that need.

More specifically, it is an object of the invention to provide a shoe sole cleaning machine in which the cleaning elements and drive motor are mounted in an improved manner as compared to prior art devices. The hinged mounting of the platform which carries the cleaning elements and the motor and fan results in greater stability and less wobbling than the mounting arrangement shown in the Burford patent. At the same time, the hinged platform allows the cleaning elements to yield as required upon the application of foot pressure.

Another object of the invention is to provide, in a shoe cleaning machine of the character described, a fan which utilizes the heat from the drive motor to blow hot air against the shoes for drying purposes. The fan is located and oriented to blow the hot air from the motor directly at the cleaning elements and through the openings they operate in, so there is no need for separate heating elements, conduits or a separate opening in the foot plate. Also, the fan is mounted directly below the foot plate where it is able to blow dirt and other debris out of the unit.

Still another object of the invention is to provide, in a machine of the character described, a cabinet that is both functional and attractive. The cabinet is preferably constructed of an attractive wood grain material which is highly appealing to potential users of the machine. The cabinet is also highly functional in that it presents a conveniently located cavity for receiving the leg and foot, a console beside the cavity which houses the circuitry and other components, a control panel at an accessible location, and a display panel for displaying promotional material and the like at a location to catch the eye of passers-by.

A further object of the invention is to provide, in a machine of the character described, a solid state control circuit having multiple functions. The circuit provides electronic audio sounds which simulate the sounds of a motor operating at a low or high speed and also controls an array of indicator lights in a manner to turn them off in sequence as the vend time elapses.

An additional object of the invention is to provide a machine of the character described in which a distinctive and appealing attract sound is emitted periodically in order to attract the attention of passers-by.

Yet another object of the invention is to provide a machine of the character described which is adjustable as to the vend time and the coinage required for operation. As a consequence, the proprietor of the machine can vary the vend time and the coinage requirements as conditions dictate.

A still further object of the invention is to provide a machine of the character described which is economical to construct and operate and which is easily maintained. In the latter regard, the components on the inside of the console are readily accessible, and the platform, motor, fan and cleaning elements can be removed as a unit for purposes of inspection and/or repair.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a perspective view of a shoe sole cleaning machine constructed according to a preferred embodiment of the present invention, with portions broken away for purposes of illustration;

FIG. 2 is a fragmentary sectional view on an enlarged scale showing the components in the botton portion of the cabinet;

FIG. 3 is a fragmentary sectional view similar to FIG. 2, but showing a shoe applied to one of the cleaning elements;

FIG. 4 is a fragmentary sectional view taken generally alone line 4—4 of FIG. 3 in the direction of the arrows;

FIGS. 5A and 5B together provide a schematic diagram of the control circuit of the machine; and FIG. 5C is an organizational diagram indicating the manner in which FIGS. 5A and 5B are to arranged.

DETAILED DESCRIPTION OF THE INVENTION

Figure 5A:
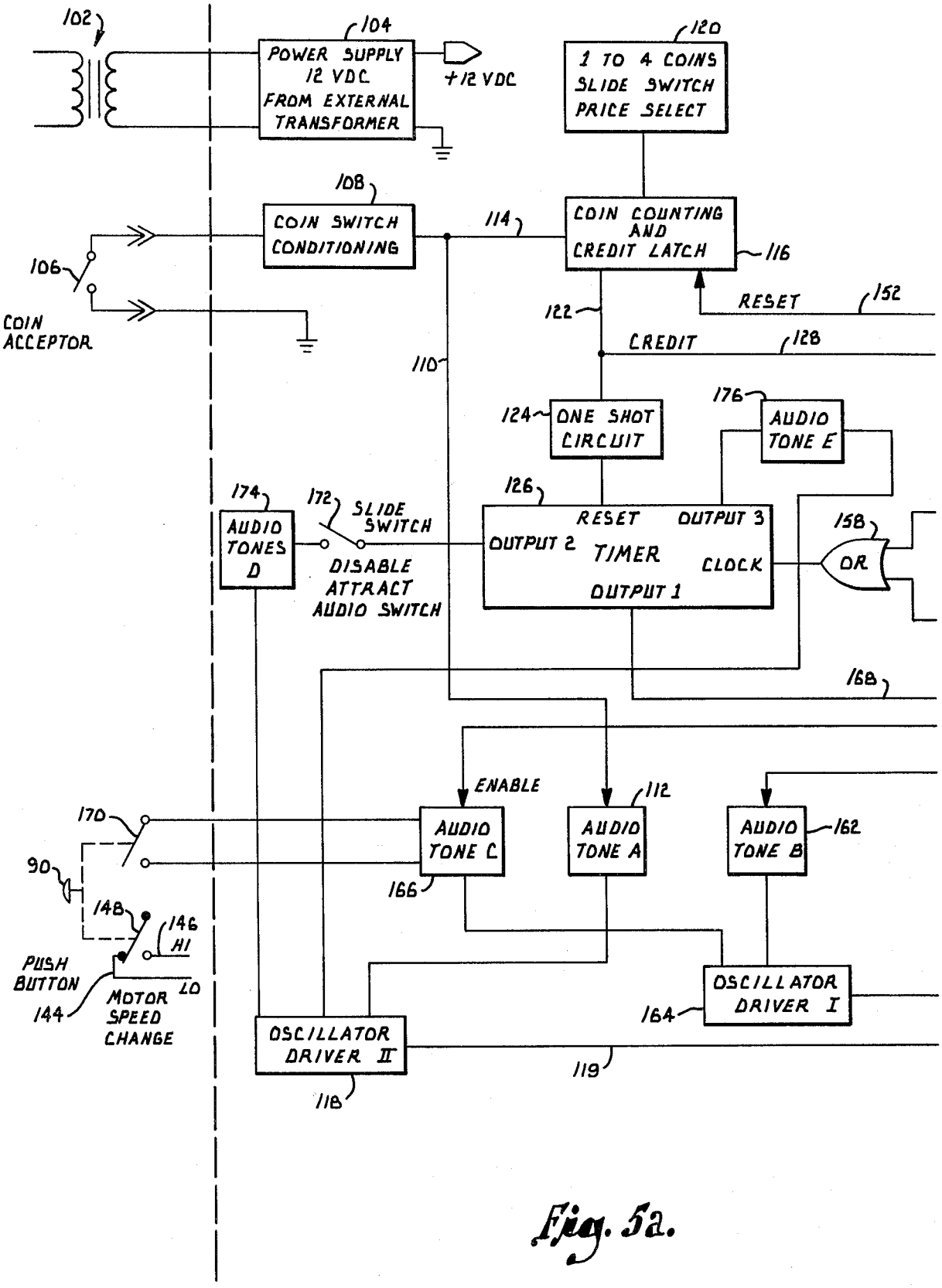
Figure 5C:
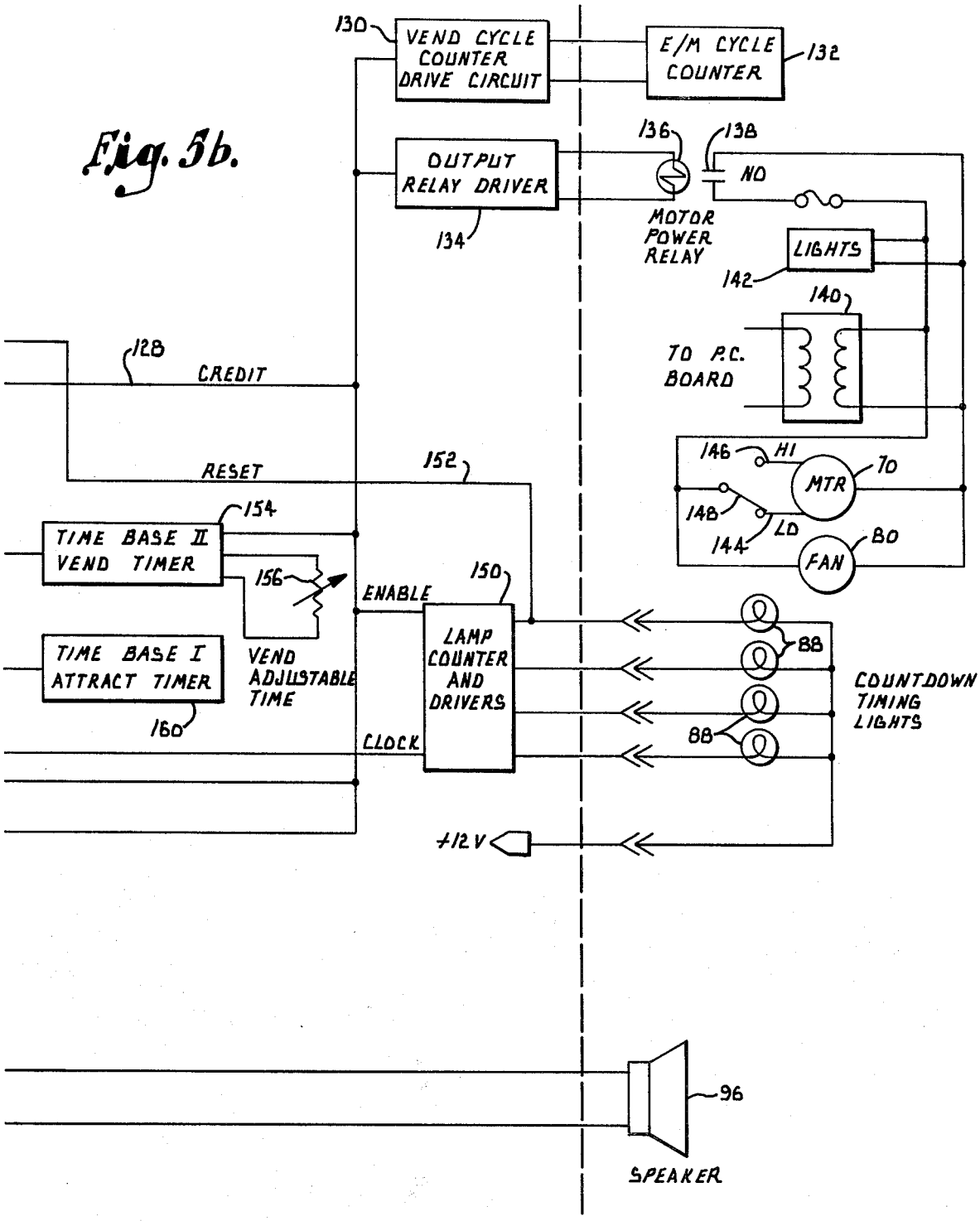
Figure 5C:
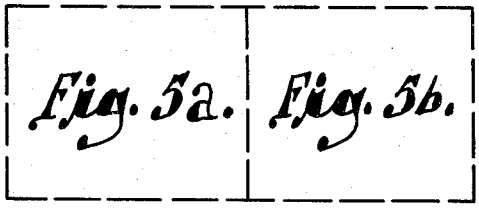

Referring now to the drawings in more detail and initially to FIG. 1, numeral 10 generally designates a shoe sole cleaning machine constructed in accordance with the present invention. The frame of the machine is formed by a wood grain cabinet which is generally designated by numeral 12 and which provides support for the operating components of the machine. The cabinet 12 includes a pair of spaced apart side walls 14 and 16 and a back panel 18. The side walls 14 and 16 are preferably formed of an attractive wood grain material to enhance the appearance of the cabinet.

The lower front portion of the cabinet presents a cavity 20 which is located adjacent to side wall 14. Located beside cavity 20 is a console 22 which is adjacent to the opposite side wall 16. The console 22 presents therein an interior compartment which contains various components of the machine such as a printed circuit board 24 and an adjustment dial 26 which permits adjustment of the vend time of the machine. On the front surface of console 22 is a coin slot 28 and a coin return slot 30. Access to the interior compartment within console 22 may be gained by unlocking and opening a door 32 which provides the coin slot 28 and the coin return slot 30.

A foot panel 34 is provided on the cabinet at a location directly beneath cavity 20. The foot panel 34 extends between side wall 14 and console 22 and inclines upwardly from front to back, as best shown in FIGS. 2 and 3. Panel 34 is raised somewhat above the bottom of the cabinet and extends to back wall 18 from a small base plate 36 located on the front of the cabinet below foot panel 34 and console 22. An enclosed compartment 38 (FIGS. 2 and 3) is formed beneath foot panel 34 and between the base plate 36, back panel 18, and side walls 14 and 16. A floor panel 40 defines the bottom of the compartment. Foot panel 34 has a pair of spaced apart openings 42 and 44 which receive the cleaning elements of the machine, as will be explained more fully.

A generally horizontal platform 46 is mounted to floor panel 40 for pivotal movement about a generally horizontal axis. A pair of blocks 48 are secured to the floor panel 40 near its front edge. Hinges 50 connect platform 46 to blocks 48 in a manner permitting the platform to pivot about the horizontal axis defined by the hinge barrels. Platform 46 is continuously biased in an upwardly direction about hinges 50 by a pair of coil springs 52 which are interposed between the floor panel and platform in a manner to act upwardly against the latter. A pair of stops 54 secured to the back panel 18 engage the rear edge of platform 46 to limit upward movement thereof, as shown in FIG. 2. Another pair of stops 56 on the back panel of the cabinet limit downward movement of the platform to the approximately horizontal position shown in FIG. 3. As an alternative, the hinges can be located at the back edge of platform 46 and the stops 54 and 56 can be on member 36.

A cylindrical brush 58 having relatively stiff bristles is carried on platform 46 to one side of an elastomeric roller 60. Brush 58 and roller 60 are mounted on the common horizontal shaft 62 which is supported by a pair of bearings 64 near one end. The bearings are mounted on blocks 66 secured to platform 46. The opposite end of shaft 62 is supported on a block 68 on the platform. Brush 58 and roller 60 are located to project partially through the respective openings 42 and 44 in foot panel 34.

Shaft 62 is driven by a conventional electric motor 70 which is mounted on platform 46. The output shaft of the motor drives a pulley 72 which, through a drive belt 74, drives a larger pulley 76 secured to shaft 62. Operation of the drive motor 70 effects driving rotation of brush 58 and roller 60 in the direction indicated by the arrow in FIGS. 2 and 3 in order to engage the sole 78 of a bowling shoe positioned on foot panel 34. The bristle brush 58 is primarily used for cleaning of leather soled bowling shoes, while the elastomeric roller 60 is normally used to clean rubber soled shoes. It is to be understood that shoes other than bowling shoes can be cleaned by the cleaning elements.

For drying of the shoe, a fan 80 is provided. The fan is mounted on a bracket 82 which is secured to platform 46. Fan 80 is oriented to direct air directly at brush 58 and roller 60 and through the openings 42 and 44 in which the cleaning elements operate. The fan is also located near one end of motor 70 such that the air which is heated by the motor is picked up by the fan and directed against a shoe sole positioned on either of the cleaning elements. In this manner, heated air is applied to the shoe sole simultaneously with the cleaning of same. A tension spring 84 may be hooked to platform 46 at one end and to floor panel 34 at the opposite end to assist the compression springs 52 in continuously urging the platform generally upwardly to extend the cleaning elements through openings 42 and 44.

The back panel 18 of the cabinet can be removed simply by removing a plurality of bolts. With the back panel removed, the floor panel 40 can be withdrawn out the back or bottom of the machine for purposes of inspecting, repairing or replacing any of the components located in compartment 38. When the floor panel 40 is removed, platform 46 and the drive motor, cleaning elements and fan are removed along with it as a unit to facilitate maintenance of the machine.

With reference again to FIG. 1 in particular, cabinet 12 includes a control panel 86 which is located directly above cavity 18 and console 22 at a location slightly above the waist of the user. The control panel 86 extends between sides 14 and 16 and inclines upwardly from front to back. The control panel includes instructions for operating the machine, along with four small lights 88 which are arranged in a row and a push button 90 which serves as a power boost button, as will be explained more fully. The height of the control panel and its inclined orientation locates button 90 at an accessible position and also locates the instructions and lights 88 at positions where they are visually accessible to the user standing in front of the machine.

Behind and above control panel 86 is the upper section 92 of the cabinet which is not as deep as the lower section. The upper section 92 presents therein a compartment which contains a light 94 and a speaker 96. A display panel 98 is presented on the front surface of the upper cabinet section 92. Promotional material such as photographs and/or endorsements by celebrities can be displayed on rectangular display areas 100 located on the display panel 98. The display areas and the promotional materials thereon are illuminated by the light 94, and the light serves also to illuminate the interior compartment within console 22 and compartment 38 through suitable holes formed beneath the console. The light passes through openings 42 and 44 as well.

Referring now to FIGS. 5A and 5B, the machine has a solid state control circuit which is contained for the most part on printed circuit board 24 which is located within console 22. The control system operates from an external transformer 102 which is located in the back portion of the cabinet. A low voltage is supplied by the transformer 102 to a power supply 104 which in turn supplies 12 volts to the control circuit and to other components such as the lights and motor.

The control circuit includes a coin acceptor having a small micro switch 106 which is normally open but which closes when an appropriate coin is dropped into the coin slot 28. When micro switch 106 closes, a signal is provided to a coin switch conditioning circuit 108. The conditioning circuit confirms that micro switch 106 has been closed for the proper time that is to be expected from a properly functioning coin acceptor. The output from the coin switch conditioning circuit is applied to line 110 which leads to an audio tone A decoder 112 and also to line 114 which leads to a coin counting and credit latch circuit 116. Audio tone A is connected to a circuit 118 labeled oscillator driver II. The oscillator driver circuit is in turn connected with the speaker 96 via line 119.

A slide switch 120 labeled one to four coins slide switch price select connects with the coin counting and credit latch circuit 116. The slide switch 120 can be adjusted to activate the machine upon receipt of 1, 2, 3 or 4 coins. Circuit 116 compares the information on line 114 with the information provided by slide switch 120, and if the appropriate number of coins have been deposited, provides a high output on line 122. Line 122 leads to a one shot circuit 124 which in turn connects with the reset input of an internal timing circuit 126. Line 122 also leads to a credit line 128.

The credit line 128 connects with a vend cycle counter drive circuit 130 which, when a signal is applied to the credit line, causes a remote electromechanical counter 132 to advance one count. The credit line also drives an output relay driver 134 in order to activate a transistor which energizes a power relay coil 136 for the motor, light and fan circuit. The relay coil 136 remains energized until the operating time period set on the timing circuit expires.

The relay circuit includes a set of normally open relay contracts 138 which close upon energization of the power relay. The circuit is then completed and receives power from a transformer 140 in order to activate the lights which are collectively indicated at 142, the fan 80, and the drive motor 70. Motor 70 is a two speed motor. It operates in the low speed mode when current is applied to the low terminal 144 and in the high speed mode when current is applied to the high speed terminal 146. A switch 148 delivers current to the low speed terminal 144 in one position and to the high-speed terminal 146 in the other position. The position of switch 148 is controlled by the power boost push button 90, as will be more fully explained.

The credit line 128 also enables a lamp counter and driver circuit 150. This circuit is a shift register which when enabled activates the lights 88 located on the control panel 86. The line leading from circuit 150 to one of the lights 88 connects with a reset line 152 which resets the coin counting and credit latch circuit 116.

The credit line further enables a time base depicted as a time base II vend timer 154. The time base in adjustable by varying the setting of a potentiometer 156 associated with the time base II vend timer circuit. The output from circuit 154 is one input to an OR gate 158 having an output leading to the clock of the timer circuit 126. The other input to the OR gate 156 is provided by a time base I attract timer 160.

The credit line 128 also provides a signal to an audio tone B decoder 162 which connects with an oscillator driver I circuit 164. Circuit 164 connects with the speaker 96. When the credit line 128 is in a high state, audio tone B provides a continuous electronic tone which is a background sound electronically simulating the sound of an electric motor operating at a relatively low speed. The credit line 128 also provides a signal to an audio tone C decoder 166 which connects with the oscillator driver I circuit 164. When audio tone C is activated, it provides a continuous background sound which electronically simulates the sound of an electric motor operating at a relatively high speed.

As previously indicated, the clock input to the timer circuit 126 is provided by the time base II vend timer 154 through OR gate 158. Output one of timer circuit 126 connects via line 168 with the clock of the lamp counter and driver circuit 150. After a selected number of oscillations of the time base II vend timer circuit have been counted by timer circuit 126, output one of the timer circuit advances the lamp counter and driver circuit 150. Output one is placed in the high state, periodically after elapse of approximately one-fourth of the overall time cycle of the machine. As output one of the timer circuit 126 is toggled high and low, the lamp counter and driver circuit 150 sequentially turns off the lights 88. Thus, one of the lights is turned off after elapse of one-fourth of the cycle, the second light is extinguished after elapse of half of the time cycle, the third light is extinguished after elapse of three-fourths of the time cycle, and the final light is extinguished at the end of the cycle, at which time reset line 152 resets the coin counting and credit latch circuit 116 to reset the coinage to zero and place the credit line 128 in a low state.

When the power boost switch 90 is pressed, it closes a normally open switch 170 and simultaneously moves switch 148 from the low terminal to the high terminal of motor 70. Motor 70 thus goes into the high speed mode of operation to turn brush 58 and roller 60 at a higher rate of speed. Closing of switch 170 also activates audio tone C if the same is enabled by the credit line 128. When the power boost button is released, it reverts to the position wherein switch 170 is open and switch 148 is in contact with the low terminal 144 of the motor.

As previously suggested, when the machine is not in operation, the time base I attract timer 160 oscillates continuously to provide a much slower time base than the time base II vend timer 154. The time base of circuit 160 is factory set and is typically approximately 5 minutes. Thus, every 5 minutes, the attract timer provides a signal through OR gate 158 to the clock input of timer circuit 126, and an output signal is generated on output two of timer 126. If a slide switch 172 is closed, output two provides a pulse to an audio tones D block 174 which connects with the oscillator driver II circuit 118. When audio tones D are activated, a sequence of electronic tones are generated to provide a distinctive and pleasant sound for the purpose of attracting the attention of passers-by. Typically, eight tones in a preselected sequence are generated each time the audio attract feature is activated. It is noted that one or both oscillator driver circuits 118 and 164 can be operating at any time.

Output three of the timer circuit 126 leads to an audio tone E block 176 which connects with the oscillator driver II circuit 118. During the operating cycle of the machine, output three provides periodic signals to audio tone E which generates electronic tones indicating to the user of the machine that the time cycle is elapsing. The frequency of the tones generated by the audio tone E block 176 is directly proportional to the time base established by the time base II vend timer 154.

In operation, the user of the machine deposits the appropriate number of coins into the coin slot 28. The coin switch conditioning circuit 108 determines that the coins are appropriate and provides a pulse to the audio tone A decoder 112 which generates an electronic sound for each coin that is accepted. Circuit 108 also provides a pulse to the coin counting and credit latch circuit 116 which, when the proper number of coins have been deposited, places line 122 and the credit line 128 in a high state. The one shot circuit 124 resets the internal timer circuit 126.

The credit line 128 drives the vend cycle counter drive circuit 130 to advance the cycle counter 132 one count. The output relay driver 134 activates the power relay 136 in order to activate the lights 142, the drive motor 70 and the fan 80. Activation of the motor causes the brush 58 and roller 60 to rotate such that the shoe sole of the user can be placed on either the brush or the roller in order to effect cleaning thereof. At the same time, fan 80 blows hot air from the motor through the openings 42 and 44 to dry the shoe as it is being cleaned.

The signal on the credit line 128 enables the lamp counter and driver circuit 150 and the time base II vend timer 154. Circuit 150 activates all of the lights 88, while the vend timer 154 in conjunction with the timing circuit 126 sequentially turns off lights 88 as the vend cycle elapses. Audio tone E decoder 176 provides periodic electronic tones which indicate to the user that the vend cycle is elapsing. Once the last light 88 is turned out, a signal on reset line 152 effects resetting of the coin counting and credit latch circuit 116 and places the credit line 128 in a low state to terminate the vend cycle. When this occurs, the vend cycle counter drive circuit 130 and the output relay driver circuit 134 are deactivated, the time base II vend timer 154 is disabled, and audio tone B is terminated. During the vend cycle, audio tone B provides a continuous background sound which simulates the motor operating at a low speed.

During operation of the machine, the credit line 128 is in the high state to enable audio tone C. If the power boost button 90 is depressed, switch 170 is closed and audio tone C then emits a continuous background sound which electronically simulates the motor operating at high speed. The simultaneous movement of switch 148 to the high terminal 146 of the motor causes the motor to operate in the high mode, thus driving brush 58 and roller 60 at a higher rate of speed for more effective cleaning of the shoe sole. When button 90 is released, switch 170 opens and switch 148 moves into contact with the low terminal 144. The motor then operates at low speed and the audio tones revert to the background sound provided by audio tone B.

The distinctive electronic attract tones generated by the audio tones D block 174 catch the attention of passersby in order to attract them to the machine. If desired, the slide switch 172 can be opened in order to disable the attract tones. The attract tones, together with the promotional materal which is illuminated on the display panel 98, draws attention to the machine and attracts potential users to it. The sequential turning off of the lights 88 during operation of the machine and the appealing electronic sounds that are generated combine to provide the user with entertainment as well as effective cleaning of the shoe soles. The fan not only thoroughly dries the shoes but also blows away any dirt or other debris that accumulates in compartment 38. The time of each vend cycle can be varied by adjusting the potentiometer 156, and the number of coins required to operate the machine can be adjusted by changing the position of the slide switch 120. The cycle counter 132 provides the proprietor of the machine with an indication of the extent to which is is being used.

The stops 54 and 56 limit the extent to which platform 46 can pivot about the hinges 50 and thereby maintain the cleaning elements in proper operating position at all times. If the cleaning elements are depressed with excessive force either inadvertently or maliciously, the drive belt 74 slips on pulleys 72 and 76 in order to prevent possible damage to the motor.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A machine for cleaning shoe soles comprising:

a frame presenting a foot panel thereon for receiving a shoe sole and a floor panel spaced beneath the foot panel, said foot panel presenting an opening therein;

a platform;

a hinge structure mounting said platform for pivotal movement relative to said floor panel about a generally horizontal hinge axis;

a rotary shoe cleaning element supported for rotation on said platform at a location to extend partially through said opening;

a drive motor on said platform drivingly coupled with said cleaning element to effect rotation thereof, said floor panel and platform being removable from said frame as a unit together with the drive motor and cleaning element on the platform;

a removable back panel on said frame providing access to the floor panel and platform for removal thereof as a unit when the back panel is removed from the frame; and resilent means urging said platform about said hinge axis in a direction to position said cleaning element in projection through said opening to rotate against a shoe sole for cleaning of same, said resilent means yielding upon application of foot pressure to said cleaning element, thereby permitting depression of the cleaning element into the opening.

2. A machine as set forth in claim 1, including stop means for limiting pivotal movement of said platform about said hinge axis.

3. A machine as set forth in claim 1, including a pair of vertically spaced apart stop members engageable with said platform to limit pivotal movement of same in both directions about said hinge axis.

4. A machine for cleaning shoe soles, comprising:

a frame presenting a foot panel thereon for receiving a shoe sole, said panel presenting an opening therein;

a rotary shoe cleaning element supported for rotation on the frame at a location to protrude through said opening in the foot panel;

a two speed motor drivingly coupled with said cleaning element to effect rotation thereof at a relatively low speed when the motor is in a low speed mode of operation and at a relatively high speed when the motor is in a high speed mode of operation;

first electronic audio means for emitting background sound electronically simulating a motor operating at a relatively low speed when said motor is in the low speed mode;

manual switch means for effecting the high speed mode of the motor; and second electronic audio means for emitting background sound electronically simulating a motor operating at a relatively high speed when said motor is in the high speed mode.

5. A machine as set forth in claim 4, including third audio means for periodically emitting a distinctive attract sound for the purpose of attracting the attention of passers-by.

6. A machine as set forth in claim 5, wherein said attract sound includes a plurality of sequential tones.

7. A machine as set forth in claim 4, including:

means providing an operating cycle of said motor having a preselected length;

a plurality of individual lights on said frame;

means for energizing each light upon initiation of each operating cycle of the motor; and means for deenergizing said lights sequentially during the operating cycle.

8. A machine as set forth in claim 7, including third electronic audio means for emitting electronic tones periodically during the operating cycle of the motor to indicate that the time period of the cycle is elapsing.

9. A machine as set forth in claim 7, including means for counting the number of operating cycles of the motor.

10. A machine as set forth in claim 7, including means for adjusting the length of the operating cycle of the motor.

11. A machine as set forth in claim 4, including:

means on the frame for receiving at least one coin to initiate operation of the motor; and means for emitting an electronic sound upon acceptance of a coin by said coin receiving means.

12. A machine as set forth in claim 11, including means for adjusting said coin receiving means in a manner to vary the number of coins accepted by said coin receiving means before operation of the motor is initiated.

13. A machine as set forth in claim 1, wherein:

said foot panel inclines upwardly from front to back;

said platform presents a front edge portion; and said hinge structure is connected with said front edge portion of the platform to establish said hinge axis adjacent said front edge portion.

* * * * *